United States Patent [19]

Fujioka et al.

[11] Patent Number: 5,006,838

[45] Date of Patent: Apr. 9, 1991

[54] THIN FILM EL DISPLAY PANEL DRIVE CIRCUIT

[75] Inventors: Yosihide Fujioka; Toshihiro Ohba; Yoshiharu Kanatani, all of Nara; Hisashi Uede, Wakayama, all of Japan

[73] Assignee: Sharp Kabushiki Kaisha, Osaka, Japan

[21] Appl. No.: 372,135

[22] Filed: Jun. 26, 1989

Related U.S. Application Data

[63] Continuation of Ser. No. 864,509, May 19, 1986, abandoned.

[30] Foreign Application Priority Data

Jun. 10, 1985 [JP] Japan ..... 60-125384

[51] Int. Cl.[5] ..... G09G 3/30

[52] U.S. Cl. ..... 340/781; 340/811; 315/169.3

[58] Field of Search ..... 340/781, 805, 811, 718, 340/719, 766, 825.81; 315/169.1, 169.3; 358/59, 241

[56] References Cited

U.S. PATENT DOCUMENTS

| | | | |
|---|---|---|---|
| 3,885,196 | 5/1975 | Fischer . | |
| 4,032,818 | 6/1977 | Chan . | |
| 4,234,821 | 11/1980 | Kako et al. | 340/781 |
| 4,338,598 | 7/1982 | Ohba et al. . | |
| 4,367,468 | 1/1983 | Curry . | |
| 4,485,379 | 11/1984 | Kinoshita et al. . | |
| 4,622,590 | 11/1986 | Togashi | 340/825.81 |
| 4,633,141 | 12/1986 | Weber | 340/781 |
| 4,636,789 | 1/1987 | Yamaguchi et al. | 340/781 |
| 4,652,872 | 3/1987 | Fujita | 340/781 |
| 4,686,426 | 8/1987 | Fujioka et al. . | |
| 4,707,692 | 11/1987 | Higgins et al. | 340/781 |

FOREIGN PATENT DOCUMENTS

| | | | |
|---|---|---|---|
| 0101702 | 3/1984 | European Pat. Off. . | |
| 3232389 | 3/1983 | Fed. Rep. of Germany . | |
| 3518596 | 11/1985 | Fed. Rep. of Germany . | |
| 2158982 | 11/1985 | United Kingdom | 340/781 |

OTHER PUBLICATIONS

"TFEL Panel Driver", Sharp Corporation, Proceedings of S.P.I.E., vol. 386 (1983), pp. 45–48.

Nikkei Electronics, Apr. 2, 1979, "Practical Applications of Thin-Film Electroluminescent (EL) Character Display", pp. 118–141.

*Primary Examiner*—Jeffery A. Brier

[57] ABSTRACT

A thin film EL display panel is composed of an EL layer placed between scanning electrodes and data side electrodes which are arranged at right angles to the scanning electrodes. A thin film EL display panel drive circuit includes a first and a second switching circuits connected to each of the scanning electrodes to apply voltages of negative and positive polarities, respectively, with respect to the voltage of the data side electrodes; and third and a fourth switching circuits connected to each of the data side electrodes to respectively charge and discharge the EL layer corresponding to the scanning electrode.

13 Claims, 8 Drawing Sheets

FIG. 4(a)

| $\overline{NDATA}$ | $\overline{NCL}$ | NST | TRANSISTOR |
|---|---|---|---|
| X | L | X | OFF |
| X | H | L | ON |
| L | H | H | ON |
| H | H | H | OFF |

FIG. 4(b)

| PDATA | PCL | $\overline{PST}$ | TRANSISTOR |
|---|---|---|---|
| X | H | X | OFF |
| X | L | H | ON |
| H | L | L | ON |
| L | L | L | OFF |

FIG. 5

| | NP FIELD | | | | PN FIELD | | | |
|---|---|---|---|---|---|---|---|---|
| DRIVING | N ch | | P ch | | P ch | | N ch | |
| SELECTION LINE | ODD LINE | | EVEN LINE | | ODD LINE | | EVEN LINE | |
| TIMING | MODULATION | WRITE | MODULATION | WRITE | MODULATION | WRITE | MODULATION | WRITE |
| Nch SOURCE POTENTIAL | 30v | −160v | 30v | 30v | 30v | 30v | 30v | −160v |
| Pch SOURCE POTENTIAL | 30v | 30v | 30v | 220v | 30v | 220v | 30v | 30v |
| NSC | OFF | ON | OFF | OFF | OFF | OFF | OFF | ON |
| PSC | OFF | OFF | OFF | ON | OFF | ON | OFF | OFF |
| NT odd | ON | (ON) | ON | ON | ON | OFF | ON | OFF |
| NT even | ON | OFF | ON | OFF | ON | ON | ON | (ON) |
| NT odd | ON | OFF | ON | OFF | ON | (ON) | ON | ON |
| PT even | ON | ON | ON | (ON) | ON | OFF | ON | OFF |
| $\overline{\text{NCL}}$ odd | H | H | H | H | H | L | H | L |
| NST odd | L | H | L | L | L | L | L | L |
| $\overline{\text{NCL}}$ even | H | L | H | L | H | H | H | H |
| NST even | L | L | L | L | L | L | L | H |
| PCL odd | L | H | L | H | L | L | L | L |
| $\overline{\text{PST}}$ odd | H | H | H | H | H | L | H | H |
| PCL even | L | L | L | L | L | H | L | H |
| $\overline{\text{PST}}$ even | H | H | H | L | H | H | H | H |

THIN FILM EL DISPLAY PANEL DRIVE CIRCUIT

This application is a continuation of application Ser. No. 06/864,509, filed on May 19, 1986, now abandoned.

BACKGROUND OF THE INVENTION

The present invention relates to a drive circuit for a thin film EL display panel such as an AC driven capacitive flat matrix display panel.

The construction of a double insulation (or three-layered) thin film EL display panel is described below with reference to FIG. 10.

Strips of transparent electrode (2) composed of $In_2O_3$ are put in parallel to one another on a glass substrate (1). Then a dielectric layer (3) composed of $Y_2O_3$, $Si_3N_4$, $TiO_2$ or $Al_2O_3$, an EL layer (4) composed of ZnS doped in activating agent such as Mn, and another dielectric layer (3') composed of $Y_2O_3$, $Si_3N_4$, $TiO_2$ or $Al_2O_3$ each with thickness between 500 and 10,000Å are deposited in turn, by a thin film technology such as evaporation or sputtering, on the transparent electrodes (2) to form the three-layered construction. Finally, strips of counter electrode (5) composed of $Al_2O_3$ are provided, at right angle to the transparent electrode (2), on the three-layered construction.

The thin film EL element thus obtained is considered as a capacitive element in terms of circuit equivalence because the EL layer (4), clamped between the two dielectric layers (3) and (3'), is placed between the electrodes. As obvious from the voltage-to-luminance characteristic shown in FIG. 11, the thin film EL element is driven by a relatively large voltage of the order of 200 V.

Conventionally, the thin film EL display panel with such construction is driven by a field reversal drive unit which is equipped with an N-ch MOS driver and a P-ch MOS driver as scanning side electrode drive circuits and reverses the polarity for each field (for each line sequential drive of a field). Since the EL element construction is not symmetrical with respect to the emitting layer, however, application of write voltage with its polarity reversed for each field will cause luminous intensity variation in a picture element between fields, thus resulting in flickering pictures.

In the U.S. patent application Ser. No. 737,068 by Harada et al. (The British counterpart is Application No. 8513058 and the counterpart in West Germany is Application No. P3518596.1), the applicant has proposed a drive circuit which employs an N-ch high withstanding MOS driver and a P-ch high withstanding MOS driver for field reversal drive of a scanning, side electrode. This circuit reverses the polarity of the write waveform applied to a picture element for each scanning line, thereby eliminating luminous intensity irregularity caused by the polarity inversion of the voltage applied to the panel, and minimizing flickers in a picture.

With the proposed drive circuit, the scanning period of a scanning line involves three different drive periods; precharge period (10μs), discharge/pull-up charge period (10μs) and write drive period (30μs). This means at least 50μs is required for sufficiently high luminance of a scanning line. Accordingly, it is necessary to use lower frame frequency as the number of scanning side electrodes increases, which further causes a picture of a poor quality with flicker and low luminance.

In addition, according to the proposed drive circuit, the charged electrodes are discharged and the potential of the electrodes is pulled up in the reverse direction. This drive method involves large power consumption in modulation.

SUMMARY OF THE INVENTION

In view of the foregoing, the object of the present invention is to provide an EL display panel drive circuit which reduces the scanning period of one scanning line and saves power consumption in modulation.

Other objects and further scope of applicability of the present invention will become apparent from the detailed description given hereinafter. It should be understood, however, that the detailed description and specific examples, while indicating preferred embodiments of the invention, are given by way of illustration only; various changes and modifications within the spirit and scope of the invention will become apparent to those skilled in the art from this detailed description.

To achieve the above objects, a thin film EL display panel drive circuit of an embodiment of the present invention contains an EL layer between scanning electrodes and data side electrodes which are arranged at right angle to the scanning electrodes, each of the scanning side electrodes being connected with a first switching circuit and a second switching circuit for applying voltages of negative and positive polarities, respectively, with respect to the voltage of the data side electrodes, to the scanning side electrode, each of the data side electrodes being connected with a third switching circuit and a fourth switching circuit for respectively charging and discharging the EL layer corresponding to the scanning electrode.

BRIEF DESCRIPTION OF THE DRAWINGS

The present invention will become more fully understood from the detailed description given hereinbelow and the accompanying drawings which are given by way of illustration only, and thus are not limitative of the present invention and wherein:

FIGS. 4(*a*) and 4(*b*) are charts for explaining the operation of MOS IC of FIG. 1;

FIG. 5 is a chart for explaining the operation of the circuit of FIG. 1;

DETAILED DESCRIPTION OF THE INVENTION

An embodiment of the present invention is now described in detail below with reference to the drawings. It should be noted that the following description is not intended to limit the scope of the present invention. (Voltage values, for instance, may not be limited to those referred to in the following description.)

Figure 1:
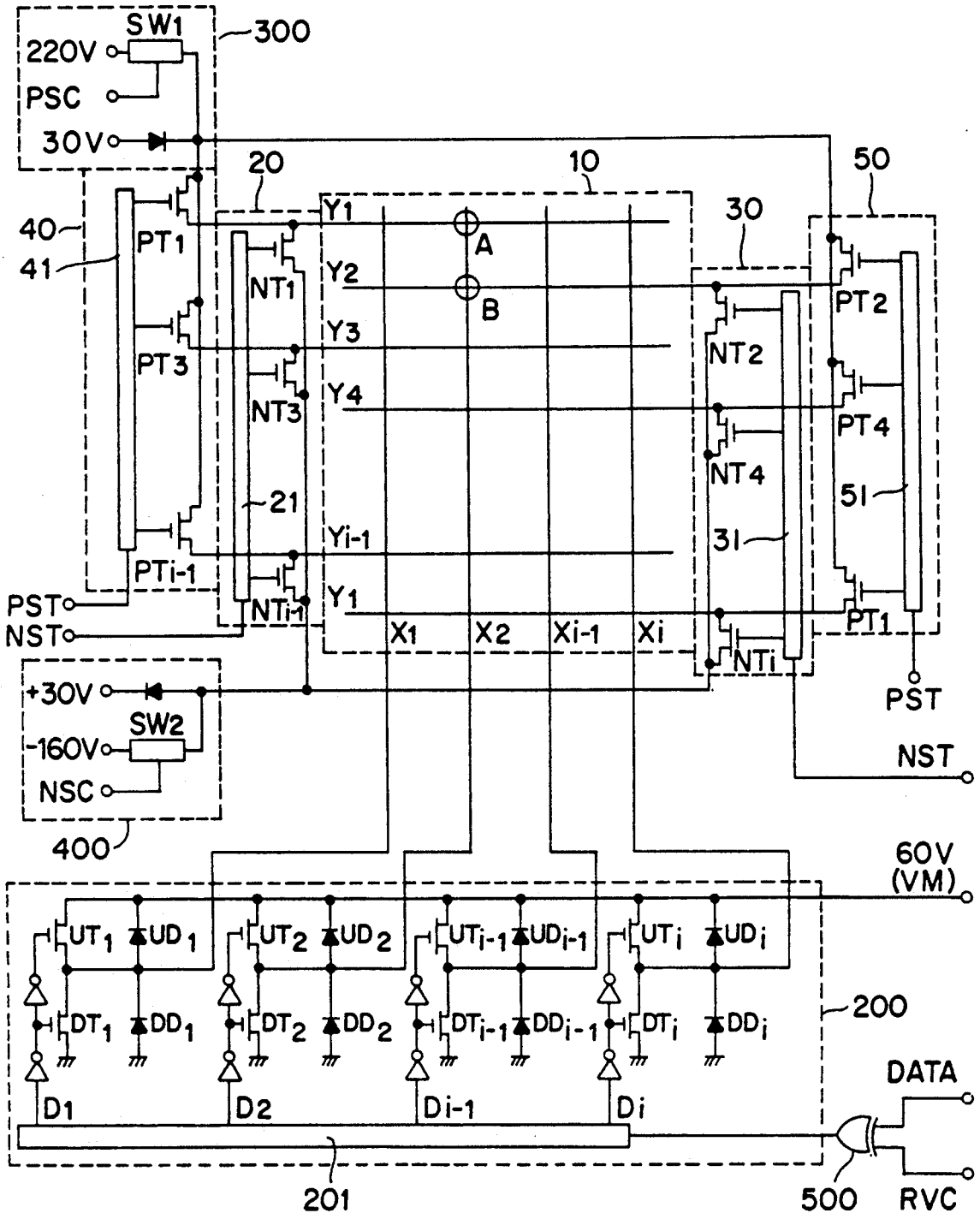
FIG. 1 is an electric circuit diagram showing an embodiment of the present invention.

FIG. 1 is an electric circuit diagram of an embodiment of the present invention.

(10) is a thin film EL display panel with emitting threshold voltage VM (=190 V) in which data side electrodes are arranged in the X direction and scanning electrodes in the Y direction. (20) and (30) are scanning side N-ch high withstanding MOS IC's corresponding to the scanning electrodes on the odd lines and even lines, respectively. (21) and (31) are logic circuits such as shift registers in the MOS IC's (20) and (30), respectively. (40) and (50) are scanning side P-ch high withstanding MOS IC's corresponding to the scanning electrodes on the odd lines and even lines, respectively. (41) and (51) are logic circuits such as shift registers in the MOS IC's (40) and (50), respectively.

(200) is a data side electrode driver IC. The driver comprises transistors ($UT_1$) through (UTi) with pull-up function. One terminal of each transistor $UT_1$-$UT_i$—. source of a voltage VM (=60 V). Transistors ($DT_1$) through (DTi) with pull-down function have one terminal which is grounded; and diodes ($UD_1$) through (UDi) and ($DD_1$) through (DDi) for applying current in the reverse direction from the currents of the transistors ($UT_1$) through (UTi) and ($DT_1$) through (DTi), respectively. These components in the driver are controlled by a logic circuit (201) such as a shift register provided in the driver IC (200).

(300) is a source potential selector circuit for the scanning side P-ch high withstanding MOS IC's. Potential of 200 V ($=VW+\frac{1}{2}\cdot VM$) or 30 V ($\frac{1}{2}\cdot VM$) is selected by a switch (SW1) which is operated by a signal (PSC).

(400) is a source potential selector circuit for the scanning side N-ch high withstanding MOS IC's. Potential of −160 V ($=-VW+\frac{1}{2}\cdot VM$) or 30 V ($\frac{1}{2}\cdot VM$) is selected by a switch (SW2) which is operated by a signal (NSC).

(500) is a data reversal control circuit.

Now, the operation mode of the circuit of FIG. 1 is described with reference to the time chart of FIG. 2.

In the description, it is assumed that the scanning electrodes $Y_1$ and $Y_2$ including picture elements (A) and (B), respectively, are selected by the line sequential drive. In this drive circuit, the voltage applied to picture elements reverses its polarity every line. The timing for applying a negative write pulse to the picture element in a selected electrode line by turning on the transistor in the N-ch high withstanding MOS IC (20) or (30) connected to the selected scanning electrode line is called N-ch drive timing. The timing for applying a positive write pulse to the picture element in a selected electrode line by turning on the transistor in the P-ch high withstanding MOS IC (40) or (50) connected to the selected scanning electrode line is called P-ch drive timing.

A field in which N-ch drive is performed for the scanning electrodes on odd lines and P-ch drive for those on even lines is called an NP field. A field in which P-ch drive is performed for the scanning electrodes on odd lines and N-ch drive for those on even lines is called a PN field.

Figure 2:
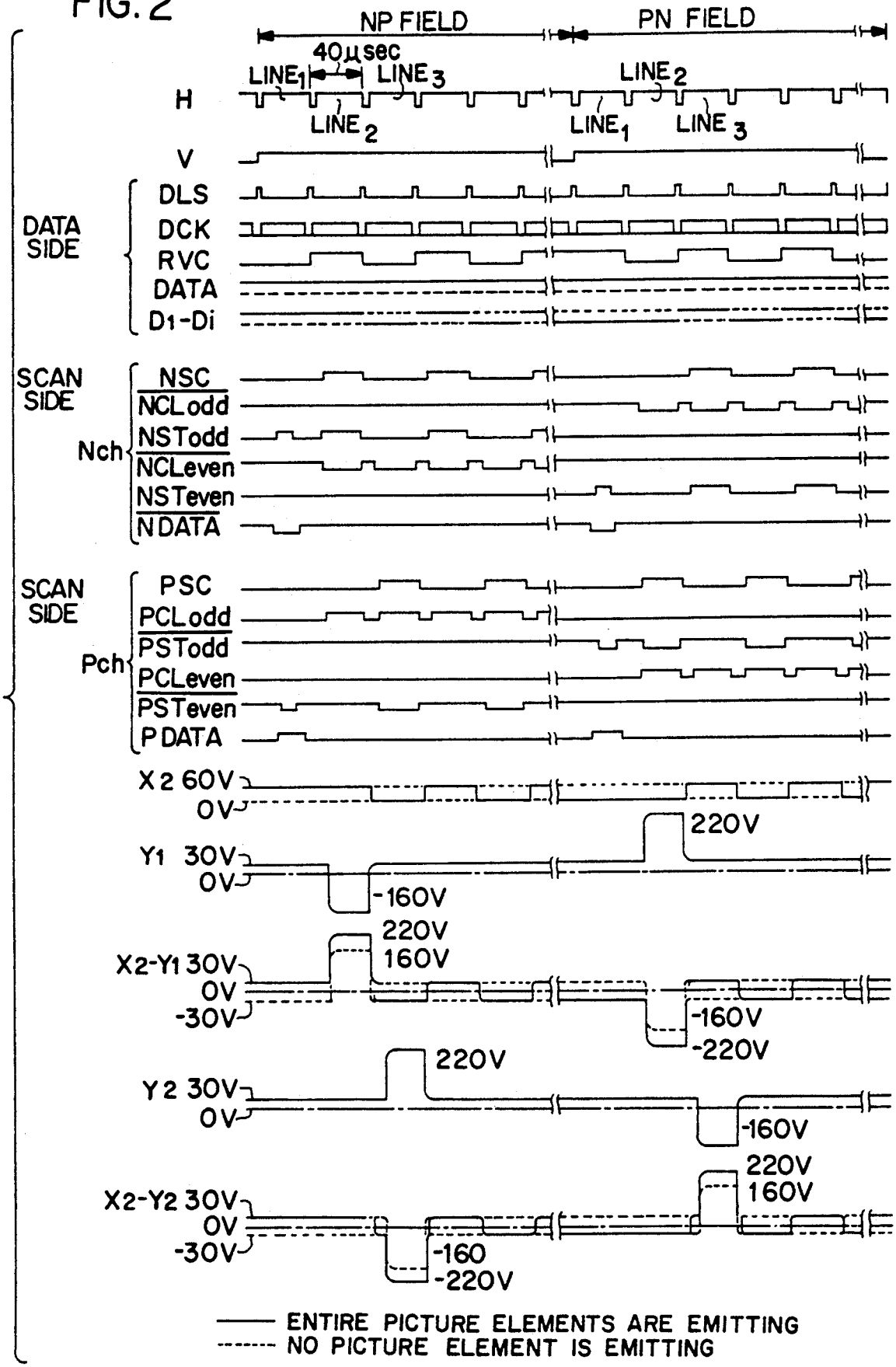
FIG. 2 is a time chart for explaining the operation mode of the circuit of FIG. 1.

Referring to FIG. 2, H is a horizontal synchronization signal in which data is effective during the high periods. V is a vertical synchronization signal. The drive for one frame starts at the rising edge of the vertical synchronization signal. DLS is a data latch signal which is output every time the data for one line has been transmitted. DCK is a data transmitting clock on the data side. RVC is a data reversal signal which is high during the data transmission period of the electrode line for which P-ch drive is conducted. It reverses all the data during the high period. DATA is a display data signal. $D_1 \sim Di$ are data input to the transistors of the data side electrode driver IC (200). For other signals, refer to Table 1 below.

TABLE 1

| | |
|---|---|
| NSC | Control signal for the source potential selector circuit (400) for the N-ch high withstanding MOS IC's |
| $\overline{\text{NCLodd}}$ | CLEAR signal for the N-ch high withstanding MOS IC for the odd lines |
| NSTodd | STROBE signal for the N-ch high withstanding MOS IC for the odd lines |
| $\overline{\text{NCLeven}}$ | CLEAR signal for the P-ch high withstanding MOS IC for the even lines |
| NSTeven | STROBE signal for the P-ch high withstanding MOS IC for the even lines |
| $\overline{\text{NDATA}}$ | Transmission data for the N-ch high withstanding MOS IC's |
| PSC | Control signal for the source potential selector circuit (300) for the P-ch high withstanding MOS IC's |
| PCLodd | CLEAR signal for the P-ch high withstanding MOS IC for the odd lines |
| $\overline{\text{PSTodd}}$ | STROBE signal for the P-ch high withstanding MOS IC for the odd lines |
| PCLeven | CLEAR signal for the P-ch high withstanding MOS IC for the even lines |
| $\overline{\text{PSTeven}}$ | STROBE signal for the P-ch high withstanding MOS IC for the even lines |
| PDATA | Transmission data for the P-ch high withstanding MOS IC's |
| CLOCK | Scanning side data transmitting clock |

In principle, the data side electrodes are driven by switching over the voltage applied to the data side electrode lines between VM (=60 V) and 0 V, at cycles of one horizontal period according to the display data (H: luminous, L: non-luminous).

Figure 3A:
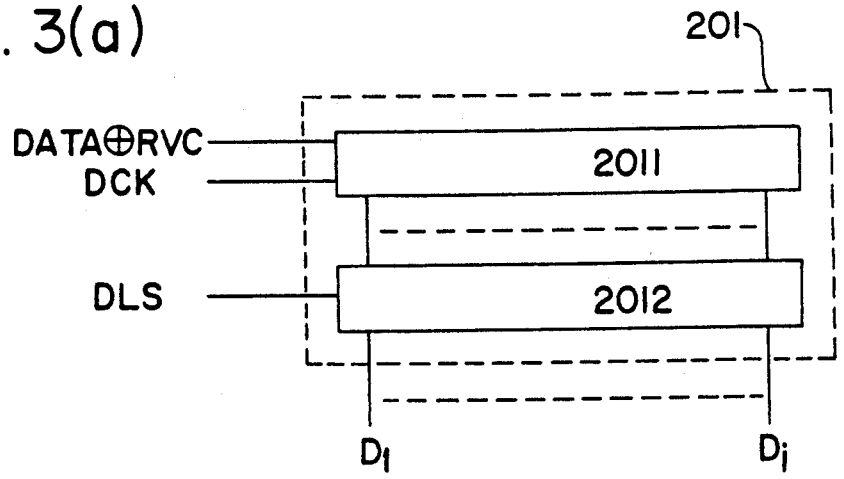
FIGS. 3(*a*), 3(*b*) and 3(*c*) are charts for explaining the logic circuit of FIG. 1.
Figure 3B:
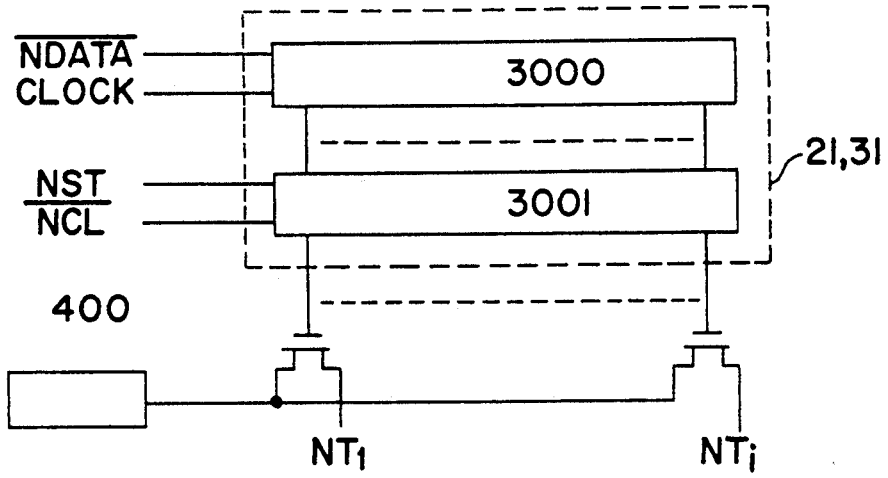
Figure 3C:
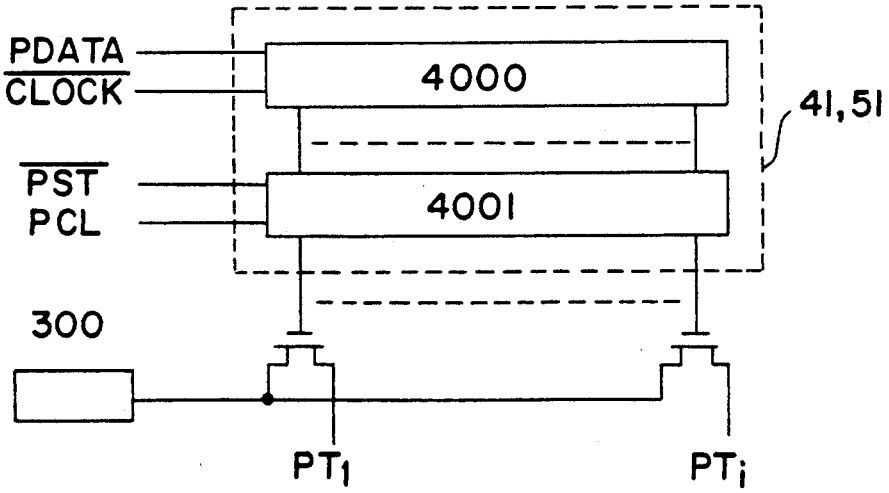

The voltage switch-over timing is described now with reference to FIG. 3(*a*) which shows the internal construction of the logic circuit (201). While a certain data side electrode line is being driven, outputs of EXCLUSIVE-OR between the display data (H: luminous, L: non-luminous) for the subsequent lines and the signal RVC are sequentially input into the shift register (2011) with memory capacity for one line. Upon completion of data transmission for one line, the EXCLUSIVE-OR inputs, (DATA)+(RVC), in the shift register are transferred by the signal input DLS into a latch circuit (2012) and stored there until the end of the present drive timing. The transistors ($UT_1$) through (UTi) and ($DT_1$) through (DTi) are controlled by the output of the latch circuit (2012). Accordingly, voltage applied to the data side electrodes is switched over at the cycle of one horizontal period for each signal input of DLS.

The signal RVC is high during the data transmission period for the line for which P-ch drive is performed. During this period, the signal reverses data by the following method:

In the P-ch drive, as mentioned later, the transistor of the P-ch high withstanding MOS IC's (40) or (50) is turned ON to raise voltage for the selected scanning electrode line to [$VW+\frac{1}{2}\cdot VM$] (=220 V) and reduces voltage for the selected data side electrode line to 0 V so that voltage of [$VW+\frac{1}{2}\cdot VM$] is applied to the picture element for luminous emission. Meanwhile voltage for the electrode lines not selected is maintained at VM (=60 V) so that voltage of $(VW+\frac{1}{2}\cdot VM)-VM=160$ V is applied to the picture elements. Since this voltage value is below the threshold for luminous emission, the picture elements do not emit light. To achieve the P-ch drive, the transistor (UTn) connected to the selected data side electrode line N is turned OFF and the transistor (DTn) turned ON. For the electrode line M which is not selected, the transistor (UTm) is turned ON while the transistor (DTm) is turned OFF. In other words, the data input for the selected line, Dn, must be low and that for the line not selected, Dm, must be high. Since this is a reversal from the display data input (H: luminous, L: nonluminous), the signal RVC for inverting data is required. Waveform of voltage applied to the data side electrodes thus driven is indicated by $X_2$ in FIG. 2. The solid line shows the waveform when the entire picture elements are emitting, and the broken line shows the waveform when no picture element is emitting.

The drive method for the scanning side electrodes is described now. The internal construction of the N-ch high withstanding MOS IC's (20) and (30) and that of the P-ch high withstanding MOS IC's (40) and (50) are shown in FIGS. 3(*b*) and 3(*c*), respectively. The truth tables for the respective logic circuits are shown in FIGS. 4(*a*) and 4(*b*). The constructions of the N-ch high withstanding MOS IC's and P-ch high withstanding MOS IC's are complementary to each other. Although they have reverse logics, they have the identical construction. Therefore, only the N-ch high withstanding MOS IC's (20) and (30) are described here.

A shift register (3000) stores a selected scanning side electrodes line. It receives the signal $\overline{\text{NDATA}}$during the high period and transfers it during the low period of the CLOCK signal. In this drive circuit, the signals NSTodd and NSTeven are supplied to the N-ch high withstanding MOS IC (20) for odd lines and to the N-ch high withstanding MOS IC (30) for even lines, respectively, as the CLOCK signals, as shown in FIG. 2. The NDATA signal input to the shift register (3000) has only one low portion in a frame which low portion coincides with the first high period of the CLOCK signal (NSTodd) or (NSTeven) input after the rising edge of the signal V, as shown in FIG. 2. Thus, one CLOCK signal (NSTodd) or (NSTeven) is input for every two horizontal periods because N-ch or P-ch drive is alternately conducted for each line. Therefore, the CLOCK signal inputs into the N-ch high withstanding MOS IC's and into the P-ch high withstanding MOS IC's are staggered in the phase by one horizontal period. In the NP field, pulse signals are supplied only for the signal (NSTodd) (=CLOCKodd) to effect N-ch drive for odd lines. In the PN field, they are supplied only for the signal (NSTeven) (=CLOCKeven) to effect N-ch drive for even lines.

A logic circuit (3001) uses two signals (NST) and (NCL) to turn ON or OFF the high withstanding MOS IC transistors and to select one of the three states according to the data from the shift register (3000), whose logic is based on the truth table of FIG. 4(*a*).

The above operation is summarized in FIG. 5. As understood from the above, the operation of the drive circuit of the present invention is roughly divided into two timing blocks: NP field and PN field. When operation for the two fields has been completed, AC pulse required for luminous emission is closed for every picture element of the thin film EL display panel. Each field is further divided into two timing blocks: N-ch drive and P-ch drive. In the NP field, N-ch drive is performed for the scanning side electrode on the selected odd line and P-ch drive for the electrode on the selected even line, and vice versa in the PN field. Each of N-ch drive and P-ch drive further comprises modulation period and write period. The modulation period is about 10μsec. and the write period is 30 μsec, so that one horizontal period is about 40μsec.

The N-ch source potential and P-ch source potential are source potentials for the N-ch and P-ch high withstanding MOS IC transistors, respectively, necessary for applying a perfectly symmetrical AC waveform of amplitude sufficiently large for luminous emission to the EL display elements in the NP and PN fields.

(NSC) is a control signal for the source potential selector circuit (400) for the N-ch high withstanding MOS IC's. When (NSC) is ON (High), the source potential is $-(VW-\frac{1}{2}\cdot VM)=-160$ V. When (NSC) is OFF (Low), the source potential is $\frac{1}{2}\cdot VM=30$ V. (PSC) is a control signal for the source potential selector circuit (300) for the P-ch high withstanding MOS IC's. When it is ON (High), the source potential is $VW+\frac{1}{2}\cdot VM=220$ V. When it is OFF (Low), the source potential is $\frac{1}{2}\cdot VM=30$ V. (NTodd) is the N-ch high withstanding MOS transistor in the IC (20), (NTeven) is the N-ch high withstanding MOS transistor in the IC (30), (PTodd) is the P-ch high withstanding MOS transistor in the IC (40), and (PTeven) is the P-ch high withstanding MOS transistor in the IC (50). On/OFF operation of these transistors in each timing is shown. In FIG. 5, (ON) indicates that only the selected line is turned ON. These transistors are controlled for ON, OFF or (ON) by signals CLodd)/, (NSTodd), CLeven)/, (NSTeven), (PCLodd), STodd)/, (PCLeven) and STeven)/. The logic for each timing is shown in FIG. 5.

During the modulation period, the signals (NSC) and (PSC) are turned OFF, the P-ch and N-ch high withstanding MOS transistors on the scanning side are all turned ON, and voltage of $\frac{1}{2}\cdot VM=30$ V is applied to the entire lines on the scanning side. Meanwhile, voltage of VM or 0 V is applied to the lines on the data side according to the display data. Consequently, the electrodes with voltage of VM=60 V in the data side lines charge the picture elements through the scanning side N-ch high withstanding MOS transistor with $\frac{1}{2}\cdot VM=30$ V whose polarity is positive on the data side with respect to the voltage on the scanning side. In contrast, the electrodes with voltage of 0 V charge the picture elements through the scanning side P-ch high withstanding MOS transistor with $\frac{1}{2}\cdot VM=30$ V whose polarity is negative on the data side with respect to the voltage on the scanning side. Thus, during the modulation period, 0 V or VM=60V is selected for the data side electrodes depending upon the display data while $\frac{1}{2}\cdot VM=30$ V is applied to every electrode on the scanning side, so that the picture elements are charged with $\frac{1}{2}\cdot VM=30$ V with positive and negative polarities on the data side with respect to the voltage on the scanning side. Furthermore, even when the display data is the same, the polarities of the N-ch drive and of the P-ch drive are reversed by the signal (RVC). Accordingly, the voltage of a perfectly symmetrical AC waveform is applied to the picture elements by executing operation for the two frames: NP field and PN field.

Now, the four write periods as mentioned above will be more specifically described using the equivalent circuits shown in FIGS. 6 through 9.

Write Period of the N-ch Drive in Np Field

Figure 6A:
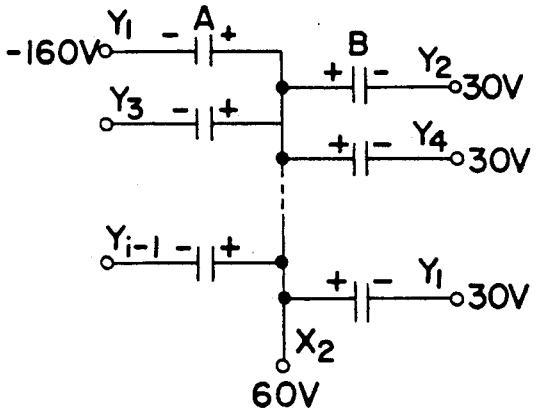
FIGS. 6 through 9 explain the operation of the circuit of FIG. 1 using the equivalent circuit.
Figure 6B:
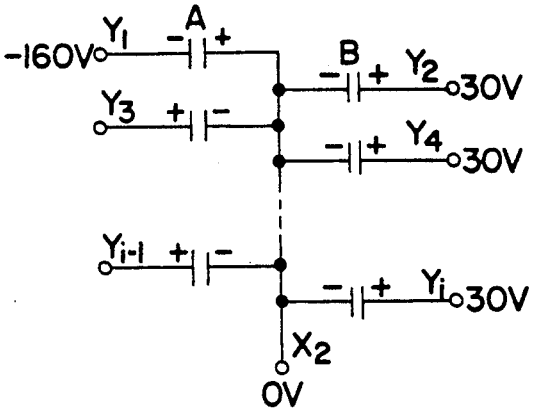

The signal (NSC) is turned ON to achieve $-(VW-\frac{1}{2}\cdot VM)=-160$ V for the N-ch high withstanding MOS transistor source potential, and the signal (PSC) is turned OFF to achieve $\frac{1}{2}\cdot VM=30$ V for the P-ch high withstanding MOS transistor source potential. To select one odd line, a transistor (NTodd) for a line is turned ON according to the data of the shift register (21) and those for the other lines turned OFF. At this time, the transistors (NTeven) and (PTodd) are all turned OFF and the transistors (PTeven) are all turned ON. On the data side, drive for the modulation period is continued. FIG. 6 shows the equivalent circuit in this state. FIG. 6(*a*) shows the circuit state in which the picture element (A) is emitting. Voltage of 60 V$-(-160$ V$)=220$ V with positive polarity on the data side is applied to the picture element (A) at the intersection between the data side line ($X_2$) and the selected line ($Y_1$) on the scanning side so that the picture element (A) emits light. FIG. 6(*b*) shows the circuit state in which the picture element (A) is not emitting. Voltage of 0V$-(-160$ V is applied to the picture element (A), but the picture element (A) does not emit light because the applied voltage is below the threshold value.

Write Period of the P-ch Drive in NP Field

Figure 7A:
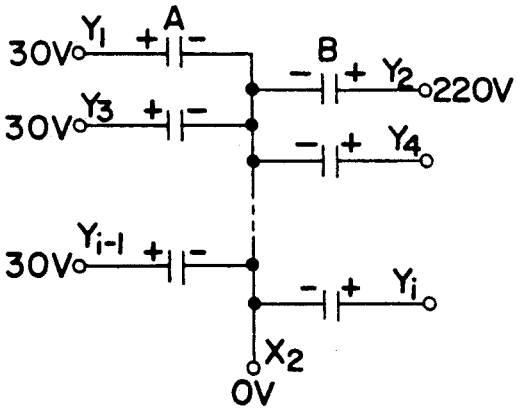
Figure 7B:
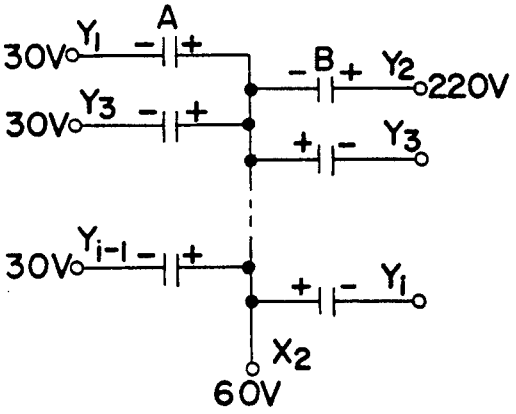

The signal (NSC) is turned OFF to achieve $\frac{1}{2}\cdot VM=30$ V for the N-ch high withstanding MOS transistor source potential, and the signal (PSC) is turned ON to achieve $VW+\frac{1}{2}\cdot VM=220$ V for the P-ch high withstanding MOS transistor source potential. One even line is turned ON with all the other lines turned OFF. At this time, the transistors (PTodd) and (NTeven) are all turned OFF and the transistors (NTodd) are all turned ON. On the data side, drive for the modulation period is continued. FIG. 7 shows the equivalent circuit in this state. FIG. 7(*a*) shows the circuit state in which the picture element (B) is emitting. Voltage of 220 V$-0$ V$=220$ V with negative polarity on the data side is applied to the picture element (B) at the intersection between the data side line ($X_2$) and the selected line ($Y_2$) on the scanning side so that the picture element (B) emits light. FIG. 7(*b*) shows the circuit state in which the picture element (B) is not emitting. Voltage of 220 V$-60$ V$=160$ V is applied, but the picture element (B) does not emit light because the applied voltage is below the threshold value.

Write Period of the P-ch Drive in PN Field

Figure 8A:
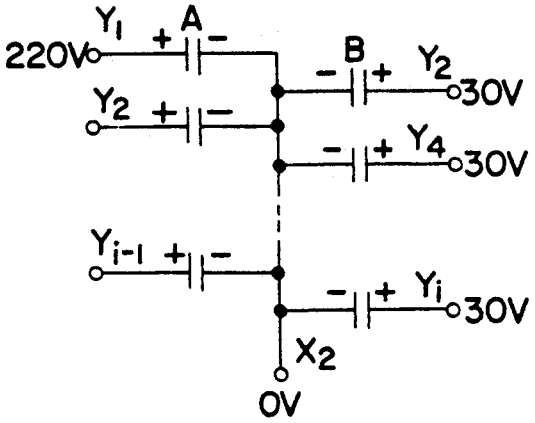
Figure 8B:
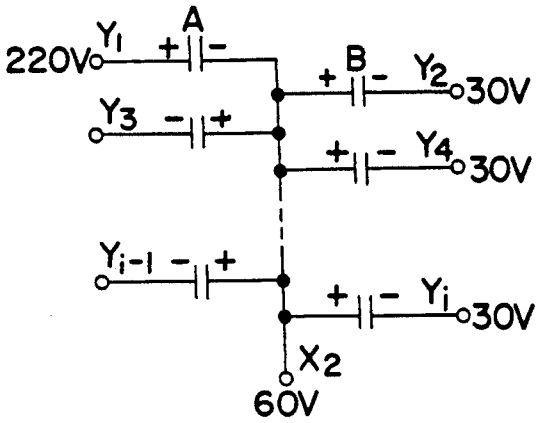

The signal (NSC) is turned OFF to achieve $\frac{1}{2}\cdot VM=30$ V for the N-ch high withstanding MOS transistor source potential, and the signal (PSC) is turned ON to achieve $VW+\frac{1}{2}\cdot VM=220$ V for the P-ch high withstanding MOS transistor source potential. To select one odd line, a transistor (PTodd) for a line is turned ON according to the data of the shift register (41) and those for the other lines turned OFF. At this time, the transistors (PTeven) and (NTodd) are all turned OFF and the transistors (NTeven) are all turned ON. On the data side, drive for the modulation period is continued. FIG. 8 shows the equivalent circuit in this state. FIG. 8(a) shows the circuit state in which the picture element (A) is emitting. Voltage of 220 V$-0$ V$=220$ V with negative polarity on the data side is applied to the picture element (A) at the intersection between the data side line ($X_2$) and selected line ($Y_1$) on the scanning side so that the picture element (A) emits light. FIG. 8(*b*) shows the circuit state in which the picture element (A) does not emit. Voltage of 220 V$\Delta$60 V$=160$ V is applied, but the picture element (A) does not emit light because the applied voltage is below the threshold value.

Write Period of the N-ch Drive in PN Field

Figure 9A:
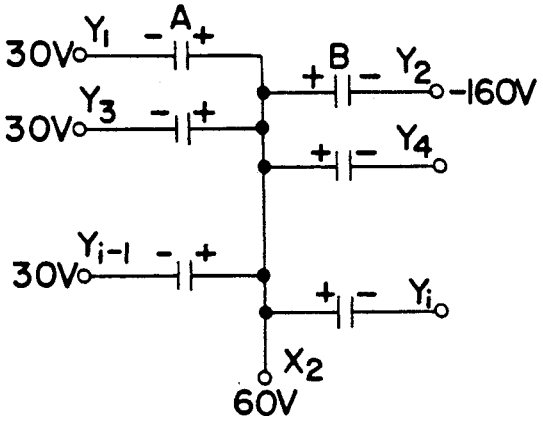
Figure 9B:
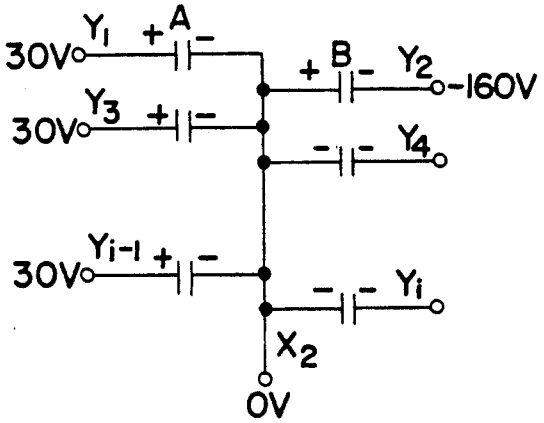
Figure 10:
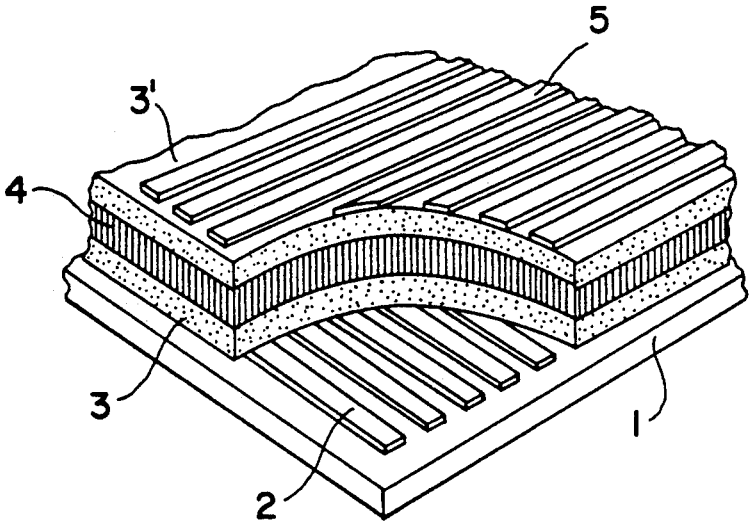
FIG. 10 is a partially cut-away perspective view of a thin film EL display panel.
Figure 11:
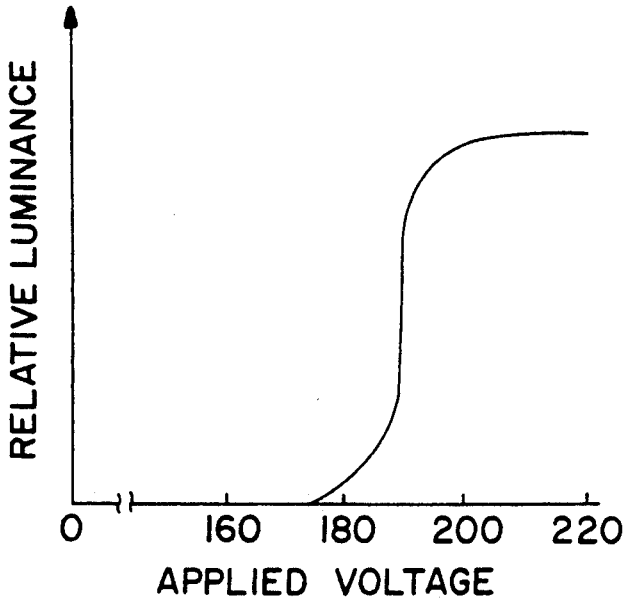
FIG. 11 is a graph showing the voltage-to-luminance characteristic of the thin film EL display panel.

The signal (NSC) is turned ON to achieve $-(VW-\frac{1}{2}\cdot VM)=160$ V for the N-ch high withstanding MOS transistor source potential, and the signal (PSC) is turned OFF to achieve $\frac{1}{2}\cdot VM=30$ V for the P-ch high withstanding MOS transistor source potential. To select one even line, a transistor (NTeven) for a line is turned ON according to the data of the shift register (31) and those for the other lines turned OFF. At this time, the transistors (NTodd) and (PTeven) are all turned OFF and the transistors (PTodd) are all turned ON. On the data side, drive for the modulation period is continued. FIG. 9 shows the equivalent circuit in this state FIG. 9(a) shows the circuit state in which the picture element (B) is emitting. Voltage of 60 V $-(-160$ V$)=220$ V with positive polarity on the data side is applied to the picture element (B) at the intersection between the data side line ($X_2$) and selected line ($Y_2$) on the scanning side so that the picture element (B) emits lights. FIG. 9(*b*) shows the circuit state in which the picture element (B) does not emit. Voltage of 0 V$-(-160$ V$)=160$ V is applied, but the picture element (B) does not emit light because the applied voltage is below the threshold value.

According to the present invention, write pulses of positive and negative polarities are applied to the selected electrode on the scanning side due to the N-ch and P-ch high withstanding MOS IC's on the scanning side, thus permitting a low withstanding driver IC to be used on the data side. Accordingly, operation on the data side only involves ON/OFF of 60 V which corresponds to the modulation voltage VM. When switching operation is conducted under a high voltage on the scanning side, however, high voltage would be applied to the data side due to capacitive coupling in the transient period, destroying the low withstanding driver IC. To avoid high voltage application on the data side in the transient period, a modulation period is provided so that voltage of $\frac{1}{2}\cdot VM=30$ V is applied to the scanning side and voltage of 0 V or VM$=60$ V is selectively applied to the data side according to the display data, to charge the picture elements. Then, during the write period, a write pulse is applied to the scanning side selected line while the drive for the modulation period is continued for all the lines not selected on the scanning side (all the even lines when an odd line is selected and all the odd lines when an even line is selected) and for all the data side lines. Here, attention is paid on the data side line ($X_2$). The electrostatic capacitance between the line ($X_2$) and the scanning side selected line is Cel for one picture element, while the electrostatic capacitance between the line ($X_2$) and the total lines of the group not selected which is clamped at $\frac{1}{2}\cdot VM=30$ V is $\frac{1}{2}\cdot i\cdot Cel$. Since i represents the total number of the scanning side lines, the value of $\frac{1}{2}\cdot i\cdot Cel$ is significantly large compared to the value of Cel. Therefore, even at the moment when a high voltage is applied to the scanning side selected line, the potential of the line ($X_2$) is virtually constant because of the capacitance distribution. Thus, in the present invention, the characteristic of a capacitive matrix panel is utilized to prevent high voltage from being applied to the data side, permitting a low withstanding MOS IC to be used on the data side.

When drive as mentioned above is conducted with a driver IC of push-pull construction chargeable and dischargeable according to the display data on the data side, it is possible to reduce the execution time for one horizontal period to about 40μsec which is about 20 to 30% shorter than the execution time with the conventional drive circuit. As a result, it becomes possible to increase the number of scanning side electrodes without decreasing the frame frequency. Thus, a large display capacity EL display panel that can provide pictures of high quality with sufficient luminance and free from flicker can be achieved without involving frame frequency reduction. (Reduction in the frame frequency has been inevitable to attain such a display panel of high quality with the conventional drive circuit.) Since a low withstanding driver IC can be used on the data side, cost for the drive IC can be also reduced.

Other advantages of the drive circuit of the present invention are as follows: The pulse voltage waveforms of positive and negative polarities applied to the picture elements of the EL display panel are perfectly symmetrical throughout the drive period including the modulation period, which helps eliminate the burning resulting from polarization and therefore enhances the long-term reliability of the display panel.

In addition, power consumption for modulation is reduced to $\frac{2}{3}$ that with the conventional drive circuit, for the following reason: For full emitting display with the conventional drive circuit, in the N-ch drive, the entire picture elements are charged with $\frac{1}{2}\cdot VM$ from the data side in the first stage, and in the second stage voltage of $\frac{1}{2}\cdot VM$ is applied to the picture elements from the scanning side with the electrodes on the data side floating so that they are not charged. Assuming the capacity of the entire picture elements is $C_0$, therefore, power consumption for modulation in the two stages is $C_0\cdot(\frac{1}{2}\cdot VM)$. In the P-ch drive, the entire picture elements are charged with $\frac{1}{2}\cdot VM$ from the data side in the first stage, and in the second stage the entire picture elements are discharged with the electrodes on the data side at 0 V and newly charged with $\frac{1}{2}\cdot VM$ from the scanning side. Power consumption for modulation is, therefore $C_0\cdot(\frac{1}{2}\cdot VM)^2+C_0\cdot(\frac{1}{2}\cdot VM)^2=2\cdot C_0\cdot(\frac{1}{2}\cdot VM)^2$. Thus, the total modulation power requirement for the entire picture elements for one AC cycle is the sum of power consumption for modulation in the N-ch drive and that in the P-ch drive $=C_0\cdot(\frac{1}{2}\cdot VM)^2+2\cdot C_0\cdot(\frac{1}{2}\cdot VM)^2=3\cdot C_0\cdot(\frac{1}{2}\cdot VM)^2$. Comparatively, with the drive circuit of the present invention, N-ch drive and P-ch drive involve the same power consumption for modulation and require opposite charging polarities. In each of N-ch and P-ch drives, 0 V or VM is applied to the data side assuming the reference potential on the scanning side at $\frac{1}{2}\cdot VM$, and the entire picture elements are charged with $\frac{1}{2}\cdot VM$ only once. Power consumption for modulation in each drive is therefore $C_0\cdot(\frac{1}{2}\cdot VM)^2$. Accordingly, the total modulation power requirement for the entire picture elements for one AC cycle is the sum of power consumption for modulation in the N-ch drive and that in the P-ch drive $=C_0\cdot(\frac{1}{2}\cdot VM)^2+C_0\cdot(\frac{1}{2}\cdot VM)^2=2\cdot C_0\cdot(\frac{1}{2}\cdot VM)^2$. It should be understood from the above description that the drive circuit of this invention requires power consumption for modulation of $\frac{2}{3}$ that by the conventional drive circuit. The invention has been described for full emitting display mode. In any other display mode, the N-ch drive and P-ch drive of the present invention are complementary and can save power consumption for modulation by the same ratio as above.

According to the present invention, as clear from the above, time required for scanning one scanning line is reduced by 20% to 30% compared to that by the conventional drive circuit, so that the drive circuit can drive an EL display panel with a larger number of scanning side electrodes if the frame frequency is the same.

Furthermore, since a low withstanding driver IC which only provides for the modulation voltage is used for the data side driver IC, the entire cost for the display panel is also reduced.

Since pulse voltage waveforms with positive and negative polarities applied to the picture elements are perfectly symmetrical all through the drive time including the modulation period, burning of the EL layer resulting from polarization is avoided, remarkably lengthening the service life of the display panel.

Since about 70% of the total power requirement of the display panel is for modulation, reduction in the power consumption for modulation to $\frac{2}{3}$ of that by the conventional drive circuit contributes to the substantial power conservation.

While only certain embodiments of the present invention have been described, it will be apparent to those skilled in the art that various changes and modifications may be made therein without departing from the spirit and scope of the present invention as claimed.

What is claimed is:

1. A drive circuit for a thin film electroluminescent (EL) display panel having a plurality of scanning electrodes extending in one direction, a plurality of data electrodes extending in a second direction orthogonal to said first direction, and an EL layer sandwiched therebetween, picture elements being defined by intersections of said scanning and data electrodes, said picture elements being controllably selected to cause luminescence thereof, the circuit comprising:

first switching circuit means connected to each of said scanning electrodes for applying a scanning voltage of negative polarity thereto;

second switching circuit means connected to each of said scanning electrodes for applying a scanning voltage of positive polarity thereto;

data electrode driver means connected to said data electrodes for selectively applying a modulation voltage or ground voltage to each said data electrode;

said scanning electrodes being grouped into odd numbered scanning electrodes and even numbered scanning electrodes and being scanned in two fields in which odd numbered scanning electrodes are provided with said negative polarity voltage and even numbered scanning electrodes are provided with said positive polarity voltage in a first field, said negative and positive polarity voltage being applied to said even and odd numbered scanning electrodes, respectively, in a second field;

said data electrode driver means including means for applying said modulation voltage to data electrodes defining selected picture elements along intersecting selected odd numbered scanning electrodes in said first field, applying ground to data electrodes defining selected picture elements along intersecting selected even numbered scanning electrodes in said first field, applying ground to data electrodes defining selected picture elements along intersecting selected odd numbered scanning electrodes in said second field, applying said modulation voltage to data electrodes defining selected picture elements along intersecting selected even numbered scanning electrodes in said second field, and applying voltage levels to data electrodes defining non-selected picture elements along intersecting selected scanning electrodes in each field of a different voltage to that applied to data electrodes defining selected picture elements intersecting selected scanning electrodes to inhibit selection of said non-selected picture elements.

2. The drive circuit of claim 1 wherein said first switching circuit means includes, an odd site first type channel high voltage driver connected to said odd scanning electrodes for applying negative write voltage thereto, and an even side first type channel high voltage driver connected to said even scanning electrodes for applying negative write voltage thereto; and said second switching circuit means includes, an even side second type channel high voltage driver connected to said even scanning electrodes for applying positive write voltage thereto; and an odd side second type channel high voltage driver connected to said odd scanning electrodes for applying positive write voltages thereto.

3. The drive circuit of claim 1 wherein said data electrode driver means includes, a pair of serially connected switches, associated with each said data electrode, connected between said modulation voltage and said ground voltage, said associated data electrode being connected between said switches, and first and second diodes, associated with each said data electrode, each connected across one of said pair of switches and being conductive in the direction opposite normal switch conduction.

4. The drive circuit of claim 3 wherein said data electrode driver means further includes, a shift register serially receiving data to be displayed; and inverter means, connected between each stage of said shift register and a control terminal of each said switch to control the conduction of one switch of each switch pair to selectively supply said modulation voltage or ground to the associated data electrode.

5. The drive circuit of claim 4 wherein said data electrode driver means further includes, frame switching means for inverting the data transmitted to said shift register for each alternate sequential scanning electrode to develop a display at a selected picture element on a said data electrode.

6. The drive system of claim 5 wherein said frame switching means comprises an exclusive OR gate inverting said data in alternate lines.

7. The drive circuit of claim 5 wherein said voltage level applied to data electrodes defining non-selected picture elements along intersecting selected scanning electrodes is said modulation voltage or ground.

8. A method of driving an electroluminescent display panel including an electroluminescent layer disposed between a group of scanning electrodes and a group of data electrodes, said scanning electrodes being arranged in alternating odd and even groups, comprising:

(a) applying a first voltage pulse of a first polarity having sufficient voltage to cause electroluminescence to selected pixels of an odd scanning line;

(b) applying a second voltage pulse of a second polarity also having sufficient voltage to cause electroluminescence to selected pixels of an even scanning line adjacent said odd scanning line;

repeating said steps (a) and (b) to successive odd and even scanning lines until said first and second voltage pulses have been applied to all said scanning electrodes;

(c) applying said second voltage pulse to selected pixels of an odd scanning line;

(d) applying said first scan voltage pulse to selected pixels of an even scanning line adjacent said odd scanning line;

repeating said steps (c) and (d) to successive odd and even scanning lines until said first and second voltage pulses have been applied to all said scanning electrodes;

said first and second voltage pulses supplied to each said scan line in steps (a) and (b) having a constant phase difference from the first and second voltage pulses supplied therein during said steps (c) and (d) on each said scan line;

said first and second voltage pulses in said steps (a–d) being formed from the simultaneous application of said scan pulses on a selected said scanning line and a modulation waveform on each said data line, the sum of each said scan pulse and said modulation waveform on pixels extending along a non-selected said data line being insufficient to cause electroluminescence.

9. The method of claim 8 wherein said scan pulses applied to said selected scan line are of a relatively high scan voltage level, said modulation waveform being supplied to said data lines by a low-voltage withstand data drive circuit which may be damaged by said relatively high scan voltage level;

said method supplying a relatively low voltage to said even scanning lines in said steps (a) and (c) and said odd scanning lines in said steps (b) and (d), said modulation voltage supplied to non-selected said data lines being intermediate the voltage of said scan pulse supplied said selected scan line and said relatively low voltage;

capacitive loading of said nonselected data lines during said steps (a) and (c) by said relatively low voltage supplied said even scan lines inhibiting transfer of said scan pulse to said nonselected data line, capacitive loading of said nonselected data lines driving said steps (b) and (d) by said relatively low voltage supplied said odd scan lines inhibiting transfer of said scan pulse to said non-selected data line, thereby preventing said high voltage scan voltage levels from appearing on said data line and damaging said low-voltage withstand data drive circuit.

10. The method of claim 9 wherein said step (b) supplies the relatively low voltage to said odd scan lines by capacitive coupling with said selected scan line to drive said odd scan lines to the relatively low voltage.

11. The method of claim 10 wherein said step (c) supplies the relatively low voltage to said even scan lines by capacitive coupling with said selected scan line to drive said even scan line to the relatively low voltage.

12. The method of claim 9 wherein said step (c) supplies the relatively low voltage to said even scan line by capacitive coupling with said selected scan line to drive said even scan lines to the relatively low voltage.

13. The method of claim 8 wherein said simultaneous application of said modulation voltage and said scan pulse to each selected said scan line allowing a high scanning speed.

* * * * *